US007984593B2

(12) United States Patent
Weiser

(10) Patent No.: US 7,984,593 B2
(45) Date of Patent: Jul. 26, 2011

(54) SURFACE FACING SYSTEM

(76) Inventor: Steffen Weiser, Crispendorf (DE)

( * ) Notice: Subject to any disclaimer, the term of this patent is extended or adjusted under 35 U.S.C. 154(b) by 0 days.

(21) Appl. No.: 12/516,902

(22) PCT Filed: Dec. 6, 2007

(86) PCT No.: PCT/DE2007/002204

§ 371 (c)(1),
(2), (4) Date: May 29, 2009

(87) PCT Pub. No.: WO2008/067803

PCT Pub. Date: Jun. 12, 2008

(65) Prior Publication Data

US 2010/0000168 A1 Jan. 7, 2010

(30) Foreign Application Priority Data

Dec. 7, 2006 (DE) ..... 20 2006 018 660 U

(51) Int. Cl.
*E04B 2/88* (2006.01)

(52) U.S. Cl. ..... 52/235; 52/506.06; 52/508; 52/512; 52/506.05

(58) Field of Classification Search ..... 52/235, 52/506.05, 506.06, 508, 511, 512; 248/205.1
See application file for complete search history.

(56) References Cited

U.S. PATENT DOCUMENTS

| | | | | | |
|---|---|---|---|---|---|
| 3,715,848 | A * | 2/1973 | Jordan P | 52/235 |
| 4,307,551 | A * | 12/1981 | Crandell | 52/235 |
| 4,866,896 | A * | 9/1989 | Shreiner et al. | 52/235 |
| 5,058,344 | A * | 10/1991 | Biebuyck | 52/235 |
| 5,065,557 | A * | 11/1991 | Laplante et al. | 52/235 |
| 5,083,405 | A * | 1/1992 | Miller | 52/235 |
| 5,220,759 | A * | 6/1993 | Hossli | 52/235 |
| 5,956,910 | A * | 9/1999 | Sommerstein et al. | 52/235 |
| 6,748,709 | B1 * | 6/2004 | Sherman et al. | 52/235 |
| 2002/0124514 | A1 * | 9/2002 | Higgins | 52/506.06 |
| 2006/0179744 | A1 * | 8/2006 | Lynch et al. | 52/235 |
| 2007/0022682 | A1 * | 2/2007 | Morgenegg et al. | 52/235 |
| 2008/0155917 | A1 * | 7/2008 | Bilge | 52/235 |

FOREIGN PATENT DOCUMENTS

| | | | |
|---|---|---|---|
| DE | 34 42 189 | * | 5/1986 |
| DE | 42 42 535 | | 6/1994 |
| DE | 198 03 150 | * | 7/1999 |
| DE | 102 60 684 | * | 7/2004 |
| DE | 103 01 140 | * | 7/2004 |
| EP | 0 291 551 | * | 11/1988 |
| GB | 243 854 | | 12/1925 |

* cited by examiner

*Primary Examiner* — Robert J Canfield
*Assistant Examiner* — Babajide Demuren
(74) *Attorney, Agent, or Firm* — Michael J. Striker

(57) ABSTRACT

A surface facing system for covering edifices includes vertical intermediate profiled members, two profiled support members, and at least one exposed element accommodated therein. A top and a bottom receiving and guiding groove is formed on the profiled support member by situating a segment on the front side of the profiled support member and a profiled holding element. The exposed element has a base frame and a plate-shaped element connected to the base frame via its back side. The base frame has at least two horizontal profiled members and at least two vertical profiled members. At least one of the vertical profiled members is connected in a non-positive, form-fit manner to the horizontal profiled members while the other vertical profiled members are connected in a form-fit manner. The exposed element is received in the receiving and guiding groove as a spring via a leg of the horizontal profiled members.

6 Claims, 5 Drawing Sheets

SURFACE FACING SYSTEM

BACKGROUND OF THE INVENTION

The present invention relates to a surface facing system, in particular for covering walls, which is composed essentially of an under-structure which is attached to the edifice, and exposed elements.

To cover ceilings, walls, and facades, it is common to attach exposed elements using an under-structure that is connected to a building. On outer walls of buildings in particular, these exposed elements which are designed as facade elements are used for aesthetic purposes and to ensure ventilation. Facade elements are known in a large number of variants of surface design, construction, and the material used therefor, such as wood, glass, plastic, ceramic, natural stone, and metal.

The facade elements must be attached to the under-structure in a manner that ensures that they are secured from falling out due to forces that may occur, and that ensures that any thermally-induced changes in length do not stress the entire structure. For this reason, the under-structure to be attached to the building in order to cover a wall or facade is designed at least to not include horizontal profiled supports for the facade elements. The lengths of the profiled supports are typically in the range of three to six meters. It must be ensured at all times that the facade elements that are attached in a section of the under-structure do not introduce any force into the particular adjacent section. The horizontal dimension of the profiled support member of the under-structure is selected such that it results from a multiple of the modular dimension of the particular facade elements to be used, thereby ensuring that adjacent sections are not bridged.

The dimensions of elements used to cover facades and other surfaces of edifices are limited in particular due to the occurrence of dilatations and the associated problem of compensating for forces that are generated; when the dimensions are large, a great deal of additional effort is required to realize the overall design.

The dimensions of facade elements are also limited by their specific material properties, such as specific weight, resistance to fracture, and elasticity. To facilitate installation, it should also be possible to handle the facade elements without the use of a heavy auxiliary device.

DE 102 60 684 A1 describes a plate-shaped facade element which is composed essentially of concrete, is provided with a reinforcement insert composed of glass fiber, and includes holding elements which are laminated in place and are used for concealed attachment.

Dimensions of 1.20 by 0.60 meters, and a surface area of less than 0.8 square meters are stated as being the most favorable, and they ensure easy handling. The associated support system includes two vertical profiled members for every facade element.

According to DE 198 03 150 A1, a further facade element for covering and outer walls and holding them, and a facade covering include fastening elements situated on the back side, which are used for concealed attachment. Advantageously, the facade elements are manufactured via extrusion, which means they have relatively small dimensions which ensure easy handling.

The facade is covered using a frame structure which is attached to the outer wall of the building, to which special vertical profiled supports are attached, in which the facade elements are hung using the fastening elements and without the use of additional safeguards.

This type of facade covering results in an overall exposed surface having fine detail.

A surface that having similar fine detail is described in DE 42 42 535 C2.

The facade element described therein, which is anchored to an under-structure which is an integral part of a building, is formed by a frame which is filled with shelving columns of small-scale plates.

GB 2 243 854 A makes known a lightweight curtain wall which includes a support frame which is mounted on an under-structure on the building, and which includes a steel plate and several wall plates situated thereon. The wall plates that have the exposed surface are provided with grooves in which sections of the profiled elements connected to the support frame engage, as holding means. A large number of support frames are mounted on H-shaped profiled elements which are connected to the building using special installation bolts, to ensure that forces and vibrations that are generated, e.g. by wind or earthquakes are absorbed.

A feature that is common to all of the solutions mentioned above is the fact that the covering of building surfaces, e.g. facades, is realized only using elements, the dimensions of which must not exceed certain values within a narrow range, and which require a complex support and under-structure.

SUMMARY OF THE INVENTION

The object of the present invention is to develop a surface facing system for covering edifices, in particular for covering walls, which is composed of an under-structure and exposed elements; it should be possible to realize the under-structure using minimal outlay, and to prefabricate the exposed elements having different exposed surfaces; they should have small masses despite their large dimensions, and they should be easy to install.

The basic idea behind the solution for a surface facing system for covering edifices, preferably for covering walls, which includes an under-structure which is attached to the edifice via vertical intermediate profiled members and which includes at least two profiled support members and at least one exposed element is that, by providing a profiled holding element on a profiled support member of the under-structure, a receiving and guiding groove is formed, in which springs situated on the exposed element are accommodated in a corresponding manner.

The exposed element is composed essentially of a base frame and a plate-shaped element which is connected to the base frame at least via its back side. The base frame is composed of at least two horizontal profiled members which are composed of metal, and of at least two profiled members situated vertically between them, at least one of the vertical profiled members being connected to the horizontal profiled members in a non-positive and form-fit manner.

Further vertical profiled members are connected to the horizontal profiled members in a non-positive manner, the vertical profiled members including guide grooves via which they are movably accommodated on a leg of the horizontal profiled members, thereby preventing the dilatation of the plate-shaped element from introducing force into the main frame.

The plate-shaped element is connected to a surface of the vertical profiled member that faces the plate-shaped element.

The selection of possible connection types is predetermined by the specific properties of the material used to make the plate-shaped element.

If the plate-shaped element is composed of materials such as wood, plastic, or minerals, or if it has a mineral base, it may be connected directly to the vertical profiled members of the main frame.

Typical connection types such as bonding, threaded connections, and riveting may be used for this purpose.

When mechanical connecting means are used, such as threaded connections or rivets, they may be concealed or they may be visible in the surface, depending on the particular design requirements.

If the surface of the exposed element is composed of metal, when it is attached via bonding, an additional mechanical safeguard may be provided, since there is a risk that the bonded connection could become detached due to thermal influences.

An exposed element having an exposed surface made of metal is composed of a base frame on which a plate-shaped element which is composed of plastic or mineral, or which has a mineral base, is attached, as the base support for a metal element.

The metal element may be bonded to the support base, or favorably, it may be accommodated on the top edge or bottom edge of the support base using U-shaped bent edges, thereby also preventing the introduction of thermally-induced stresses into the support base.

Using the metal element results in a design variant of the exposed element which includes an integrally formed drip edge in the region of its rear top edge. Via the interaction of the drip edge with a special fastening profiled element which is designed as a partially open, hollow profiled element and is used as a rain gutter, storm water that enters the region of the profiled support elements between the exposed elements may be easily carried away, thereby eliminating the need for additional seals.

The particular advantages of the present invention are, in particular, the fact that exposed elements may be realized that have dimensions that may be greater than the maximum permissible modular dimension of the profiled sections of the under- and support structure of the surface of a building to be covered, in particular a facade, since force from one section is not introduced into the other section via the exposed element.

Therefore, the exposed element no longer needs to have dimensions that are within the modular dimension of the sections of the under- and support structure, since it may be easily accommodated in adjacent sections.

The support structure may be simplified considerably when flat edifice surfaces are involved, and they are composed only of profiled support elements that are situated in parallel and are connected to a surface to be covered.

The exposed elements have low intrinsic mass, since they do not perform a support function themselves and may be easily installed on-site without using heavy auxiliary devices.

The surface facing system may be used on outer surfaces and interior walls and/or ceilings of edifices.

BRIEF DESCRIPTION OF THE DRAWINGS

The present invention is described in greater detail as an exemplary embodiment with reference to the following figures, which show.

DETAILED DESCRIPTION OF THE PREFERRED EMBODIMENTS

Figure 1:
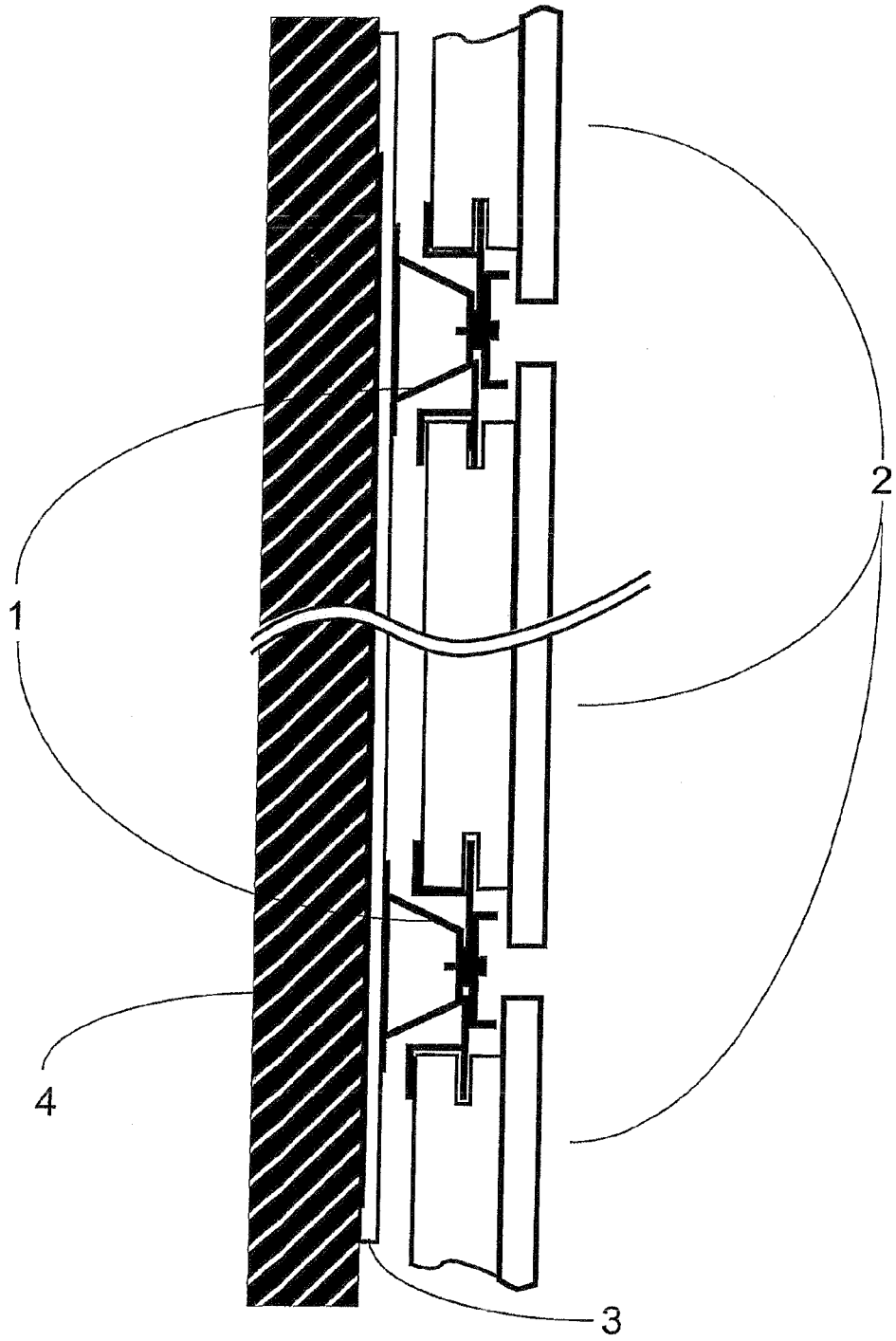
FIG. 1 a vertical cross-sectional view of a surface facing system in the region of an exposed element.

As shown in FIG. 1, a surface facing system includes profiled support members 1 and exposed elements 2; profiled support members 1 are attached to an edifice 4 using an intermediate profiled member 3.

Figure 2A:
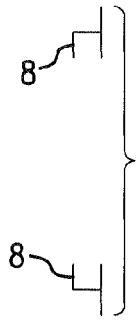
FIGS. 2, 2*a*, and 2*b* detailed front views in the region of the profiled holding element.
Figure 2:
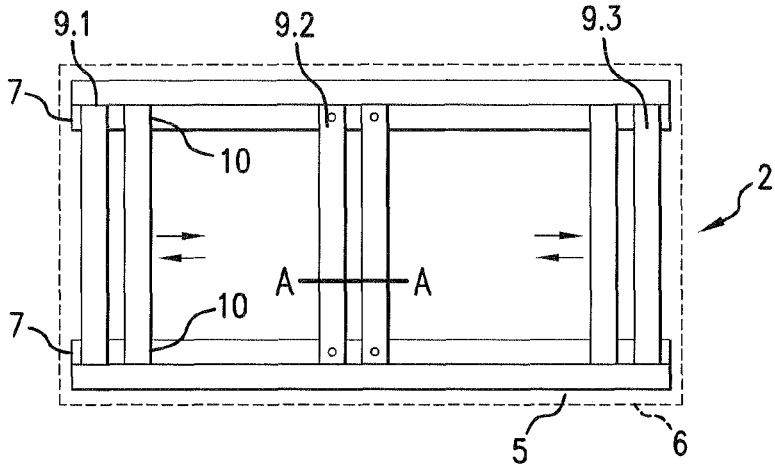
Figure 2B:
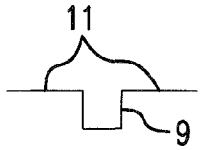

As shown clearly in the schematic depiction of an exposed element in FIG. 2, exposed elements 2 are composed essentially of a base frame 5 and a plate-shaped element 6 connected thereto. Base frame 5 is formed by two horizontal profiled members 7 which have a fork-shaped cross-section 8 and vertical hat-shaped profiled members 9, as 9.1; 9.2, and 9.3, situated therebetween; vertical hat-shaped profiled members 9 include, on both end regions, a guide groove 10 for placement on a leg of particular horizontal profiled member 7.

At least one vertical hat-shaped profiled member 9—central vertical hat-shaped profiled member 9.2 in this case—is connected to horizontal profiled members 7 in a non-positive and form-fit manner, while the further vertical hat-shaped profiled members, i.e. vertical hat-shaped profiled members 9.1 and 9.3 in this case, are connected only in a form-fit manner.

Plate-shaped element 6 is connected to rims 11 of vertical hat-shaped profiled member 9 (9.1; 9.2; 9.3).

Figure 3:
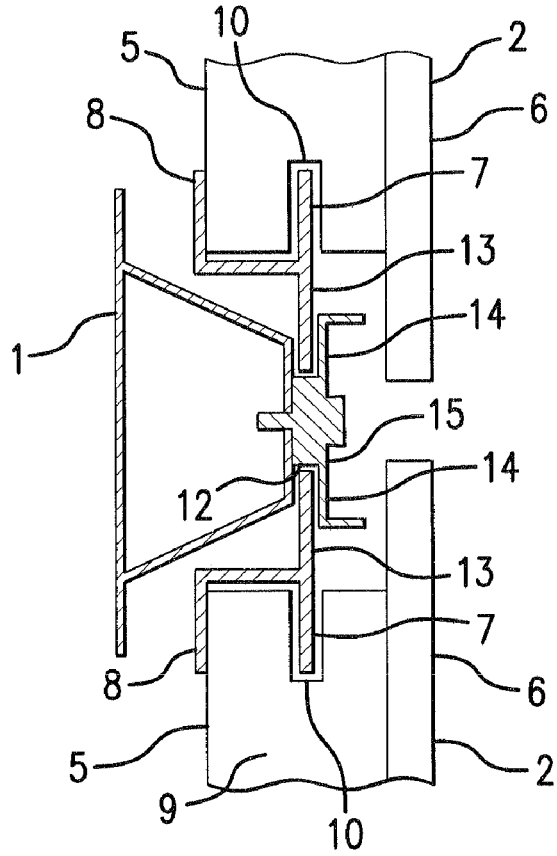
FIG. 3 a schematic depiction of an exposed element.

The detailed view shown in FIG. 3 shows how profiled support member 1 interacts with exposed elements 2 to prevent the introduction of force.

Profiled support member 1 includes, on its front side, a central segment 12, the width of which is slightly greater than that of a leg 13 of horizontal profiled member 7—which has a fork-shaped cross-section 8—of base frame 5 of exposed element 2.

Exposed elements 2 are accommodated in a non-positive manner via legs 13 of horizontal profiled members 7 of base frame 5, as springs, by a receiving and guiding groove 14 on profiled support member 1, thereby ensuring that the dilatation of base frame 5, i.e. profiled members 7; 9 may not introduce force into profiled support members 1 and, therefore, into the entire under-structure.

Receiving and guiding groove 14 which is located on the front side of profiled support member 1 above and below segment 12 results from the space formed by the width of segment 12 between the front side of profiled support 1 and the interior side of a profiled holding member 15.

Figure 4:
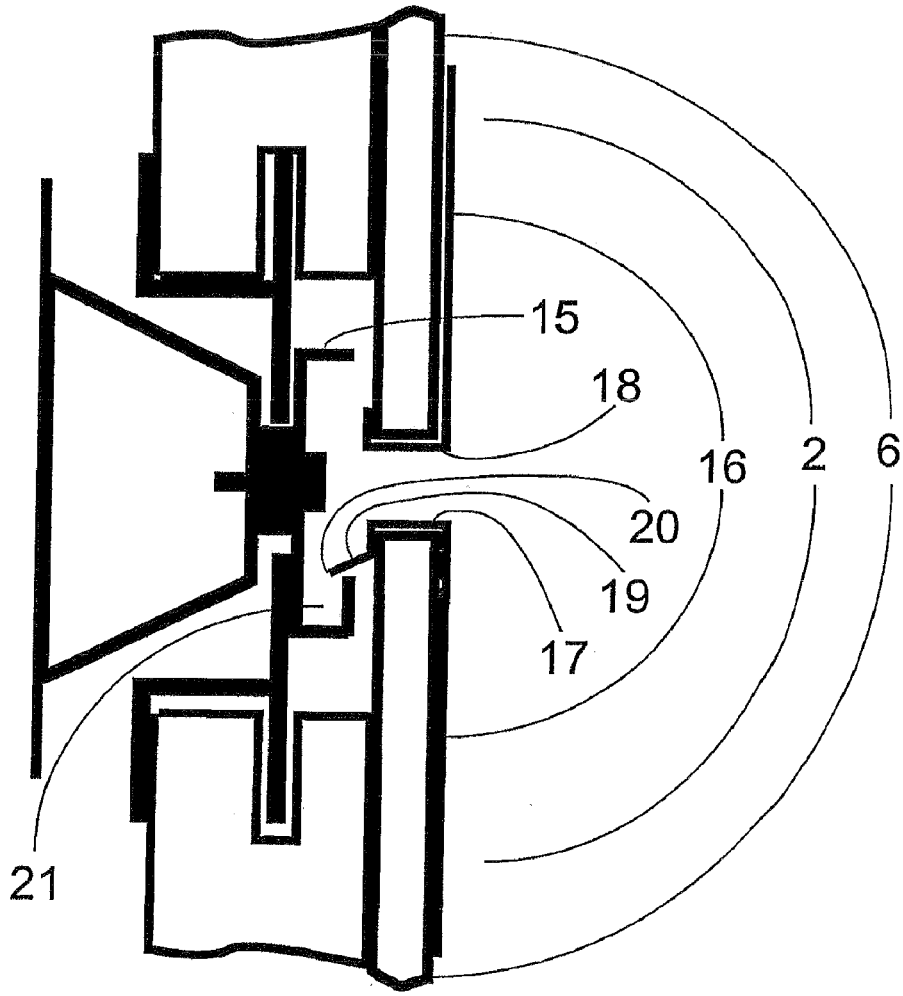
FIG. 4 a detailed view of an exposed element having a metal surface, in the region of the profiled holding element.

FIG. 4 shows, as an example, the design of exposed element 2 which includes a metal plate 16 as the exposed surface. Metal plate 16 is accommodated on plate-shaped element 6 as the support base via an upper U-shaped bent edge 17 and a lower U-shaped bent edge 18.

Upper U-shaped bent edge 17 continues as a deflection surface 19 which is slanted relative to profiled holding member 15, and which includes a drip edge 20. Storm water that enters the region between exposed elements 2 is guided via deflection surface 19 having drip edge 20 to profiled holding element 15 which is a partially open, hollow profiled element in this design variant, so that a lower closed region is used as a channel 21 for carrying away the storm water that entered.

As an alternative, upper U-shaped bent edge 17 may not be provided with deflection surface 19, and a profiled holding member 15 as shown in FIG. 3 may be used.

Metal plate 16 may be bonded to plate-shaped element 6, or it may be connected mechanically thereto.

Figure 5:
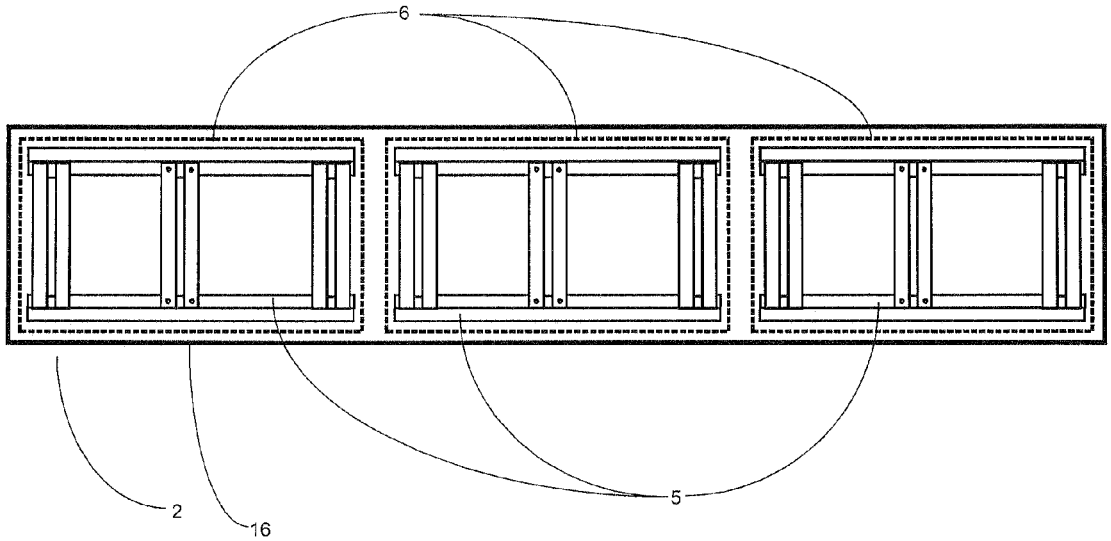
FIG. 5 a view an exposed element with a support base of several plate-shaped elements.

Furthermore, an exposed element 2 having metal plate 16 may include a support base in the form of sections composed of several plate-shaped elements 6, each of which is connected to a separate base frame 5, as shown in FIG. 5.

REFERENCE NUMERALS

1 Profiled support members
2 Exposed element
3 Intermediate profiled member
4 Edifice
5 Base frame
6 Plate-shaped element
7 Horizontal profiled members
8 Fork-shaped cross-section
9 Vertical hat-shaped profiled member (9.1; 9.2; 9.3)
10 Guide grooves
11 Rims
12 Segment
13 Leg
14 Receiving and guiding groove
15 Profiled holding element
16 Metal plate
17 Upper U-shaped bent edge
18 Lower U-shaped bent edge
19 Deflection surface
20 Drip edge
21 Channel

What is claimed is:

1. A surface facing system for covering edifices, comprising: an under-structure attached to an edifice and including vertical intermediate profiled members, two profiled support members, and at least one exposed element accommodated therein, wherein by situating a segment (12) and a profiled holding element (15) on the front side of the profiled support members (1), a top and a bottom receiving and guiding groove (14) is formed on each profiled support member (1), wherein the at least one exposed element (2) is composed essentially of a base frame (5) and a plate-shaped element (6) connected to the base frame (5) at least via its back side, wherein the base frame (5) is composed of at least two horizontal profiled members (7) and at least two vertical profiled members (9) situated therebetween, and wherein the at least one exposed element (2) is correspondingly received in a top and a bottom receiving and guiding groove (14), on the particular profiled support members (1), as a spring via a leg (13) of the horizontal profiled members (7) of the base frame (5), wherein at least one of the vertical profiled members (9) is connected in a non-positive and form-fit manner to the horizontal profiled members (7), and wherein the other vertical profiled members (9) are connected to the horizontal profiled members (7) in a form-fit and sliding manner and wherein the plate-shaped element (6) is directly attached to the vertical profiled members (9).

2. The surface facing system for covering edifices as recited in claim 1, wherein the at least one exposed element (2) has visible surface composed of metal is composed of the base frame (5) having the plate-shaped element (6) attached thereto as the support base, and a metal plate (16) which is connected to the support base.

3. The surface facing system for covering edifices as recited in claim 2, wherein the metal plate (16) is accommodated on the plate-shaped element (6) as the support base via an upper U-shaped bent edge (17) and a lower U-shaped bent edge (18).

4. The surface facing system for covering edifices as recited in claim 3, wherein the upper U-shaped bent edge (17) continues in a guiding deflection surface (19) which is slanted relative to the profiled holding element (15) and includes a drip edge (20) configured to drain storm water.

5. The surface facing system for covering edifices as recited in claim 1,wherein the profiled holding element (15) is composed of a partially open, hollow profile, as a channel (21) configured to drain storm water.

6. The surface facing system for covering edifices as recited in claim 2, wherein the at least one exposed element (2) having the metal plate (16) includes a support base in the form of sections of several plate-shaped elements (6), each of which is connected to a separate base frame (5).

* * * * *